US005197677A

United States Patent [19]

Estabrook et al.

[11] Patent Number: 5,197,677

[45] Date of Patent: Mar. 30, 1993

[54] WET GRINDING OF CRYSTALLINE ENERGETIC MATERIALS

[75] Inventors: Lee C. Estabrook; Carlos Somoza, both of Minden, La.

[73] Assignee: Thiokol Corporation, Ogden, Utah

[21] Appl. No.: 692,192

[22] Filed: Apr. 26, 1991

[51] Int. Cl.[5] ..... B02C 19/06

[52] U.S. Cl. ..... 241/5; 241/21; 241/24

[58] Field of Search ..... 241/5, 39, 40, 21, 24; 149/109.6

[56] References Cited

U.S. PATENT DOCUMENTS

| | | |
|---|---|---|
| 2,204,059 | 6/1940 | Acken . |
| 2,852,360 | 9/1958 | By . |
| 3,069,477 | 12/1962 | Lee et al. . |
| 3,158,331 | 11/1964 | Wilson et al. . |
| 3,239,502 | 3/1966 | Lee et al. . |
| 3,266,957 | 8/1966 | Stresau . |
| 3,266,958 | 8/1966 | Breazeale . |
| 3,305,414 | 2/1967 | Hodgson . |
| 3,351,585 | 11/1967 | Lee et al. . |
| 3,600,477 | 8/1971 | Friedel et al. . |
| 3,754,061 | 8/1973 | Forrest et al. . |
| 3,761,330 | 9/1973 | Low et al. . |
| 3,770,721 | 11/1973 | Robbins et al. . |
| 3,937,405 | 2/1976 | Stephanoff . |
| 4,065,529 | 12/1977 | Lavertu . |
| 4,092,187 | 5/1978 | Hildebrant et al. . |
| 4,115,166 | 9/1978 | Lista . |
| 4,156,593 | 5/1979 | Tarpley . |
| 4,265,406 | 5/1981 | Palgrave . |
| 4,410,423 | 10/1983 | Walsh . |
| 4,462,848 | 7/1984 | Elrick . |
| 4,572,439 | 2/1986 | Pitzer . |
| 4,588,575 | 5/1986 | David . |
| 4,588,576 | 5/1986 | David . |
| 4,767,064 | 8/1988 | Resch . |
| 4,783,389 | 11/1988 | Trout et al. . |
| 5,020,731 | 6/1991 | Somoza et al. . |
| 5,035,363 | 7/1991 | Somoza . |

OTHER PUBLICATIONS

*Method 102.3.1 Acidity or Alkalinity (Complete Solution Method,* MILSTD-650, pp. 1 and 2 (3 Apr. 1972).

*Unclassified Holston Defense Corporation Article,* Kingsport, Tenn. report, pp. 1 and 2 (date unknown) discusses tests performed on explosive compositions.

"The Chemical Effects of Ultrasound," Kenneth S. Suslick, *Scientific American* (Feb. 1989) discusses observations concerning effects on ultrasonic waves.

"Ultrasonic Disruption," Howard Alliger, *American Laboratory* (Oct., 1975) discusses the use of ultrasonic disruption for a variety of applications, including breaking cells and preparing extracts.

Albus, F. E., *The Modern Fluid Energy Mill,* Chemical Engineering Progress 60(6), Jun., 1964 (pp. 102-106).

Kirk-Othmer, *Encyclopedia of Chemical Technology,* 3rd Edition, vol. 21, pp. 132-162 "Size Reduction".

Albus, F. E., *Fluid Energy Grinding or Jet Milling,* Aljet Equipment Company Publication, 37 pages, (Date Unknown).

Encyclopedia of Explosives and Related Items, vol. 3, Picatinny Arsenal, Dover, N.J., pp. C 564 through C 567 (1966).

*Explosives,* by Rudolf Meyer, Verlag Chemie, Weinheim, N.Y., pp. 150 through 153 and 200 through 203 (1977).

*Detonation Propagation Tests on Aqueous Slurries of RDX. HMX M-1 and Nitrocellulose,* George Petino, Jr., (List continued on next page.)

*Primary Examiner*—Mark Rosenbaum
*Assistant Examiner*—Kenneth J. Hansen
*Attorney, Agent, or Firm*—Madson & Metcalf

[57] ABSTRACT

The particle size of a particulate energetic material such as HMX or RDX is reduced by introducing the energetic material as a water-containing slurry at less than 40 percent solids into a high velocity fluid stream in a fluid energy mill and controlling the fluid temperature, fluid velocity, and energetic material feed rate to achieve a particle size of about 10 microns or less.

23 Claims, 6 Drawing Sheets

OTHER PUBLICATIONS

Hazards Research Corp., Darl Westover, ARRADCOM. LCWSL, Defense Technical Information Center, Technical Report (Apr. 1977).

*Mass Detonation Tests of Agitated HMX Slurries*, George Petino, Jr., Hazards Research Corporation, Denville, N.J., James D. Turner, ARRADCOM, US Army Armament Research and Development Command (Oct. 1979).

The Effect of RDX Particle Size on the Shock Sensitivity Cast PBX Formulations, H. Moulard, Franco-German Research Institute; J. W. Kury, Lawrence Livermore National Laboratory; and A. Delolos, Societe Nationale des Poudres et Explosife; pp. 248 through 257 (date unknown).

WET GRINDING OF CRYSTALLINE ENERGETIC MATERIALS

BACKGROUND OF THE INVENTION

1. Field

This invention relates to the production of energetic materials. More specifically, the invention relates to means and methods for size reduction of particulate explosive materials.

2. State of the Art

Unplanned ignition of munitions is a hazard wherever munitions are made, stored, or used. Such ignition may occur due to fire, bullet or fragment impact, a shaped charge jet, or sympathetic detonation. To reduce this hazard, various means are being sought to decrease the sensitivity of energetic materials to such stimuli. Such materials are termed insensitive munitions (IM).

It has been discovered that explosive materials including RDX (cyclotrimethylene-trinitramine) and HMX (cyclotetramethylene tetra-nitramine) exhibit a decrease in sensitivity when the particle size from which the charge is formed is reduced below some threshold value, e.g. 2–7 microns. It is believed that other newly developed energetic materials having an inherent low sensitivity may also be made further insensitive by use of very small particle size. Such materials include NTO (3 nitro-1, 2, 4-triazol-5-one) and ADNBF (7-amino-4, 6-dinitrobenzofurozan).

Class 1 RDX and Class 5 RDX are specified according to military specification MIL-R-398C as having the following particle size distributions:

| Through U.S. Standard Sieve No. | Percent Passing Through Sieve | |
|---|---|---|
| | Class 1 RDX | Class 5 RDX |
| 20 (840 microns) | 98 ± 2 | — |
| 50 (297 microns) | 90 ± 10 | — |
| 100 (149 microns) | 60 ± 30 | — |
| 200 (74 microns) | 25 ± 20 | — |
| 325 (44 microns) | — | 97+ |

The approximate mean particle sizes, based on volume, for each class are:
Class 1: 100–200 microns
Class 5: 3–10 microns Class 1 RDX is prepared as a wet slurry. It is shipped and stored as a 75 percent solids slurry in a water-alcohol mixture, e.g. 40 percent isopropyl alcohol and 60 percent water.

Class 5 RDX is generally prepared from crude RDX by recrystallization and is more resistant to unintentional ignition because of the reduced particle size.

The most common method of preparing finely ground RDX and HMX is to thoroughly dry the wet crystallized material, typically to less than 0.1 percent moisture and perform size reduction with a fluid energy mill. Inadequate grinding of RDX and HMX is generally believed to occur when the material contains even small quantities of moisture.

Size reduction of other wet materials in a fluid energy mill is not considered feasible unless the elastic carrier fluid is at a temperature where the water-containing liquid is evaporated from the particles. For an energetic slurry of 10–25 percent solids, the required temperatures of the carrier fluid for wholly evaporating the water-alcohol mixture are unsafe and may result in detonation. Thus, the energetic material is predried at a lower temperature. Furthermore, dry grinding of explosive materials carries with it inherent risks of detonation. In addition, the drying process is very energy intensive and thus, costly to operate. Detonation of nitramines has been known to occur in the drying step.

The other common method for producing RDX, HMX, or CPX of smaller particle size is a recrystallization process. The original crystallization of these materials necessarily results in large particle size. The energetic material such as Class 1 RDX, for example, is produced as a highly wetted material at about 20 percent solids. A solids concentration of 80–85 percent in a water-alcohol solution is used for safe shipment and storage.

Recrystallization is typically conducted by dissolving the energetic material in a solvent such as cyclohexanone or acetone and precipitation by quenching with water. The recrystallization process is both tedious and excessively consumptive of both time and energy. The use of toxic volatile solvents presents well-known environmental hazards. One disadvantage of the recrystallization process is the wide range of resulting particle sizes.

A process is needed for rapidly, safely, and inexpensively producing energetic materials of fine particle size, i.e. less than about 5–10 microns. In addition, a process is needed for producing a finely ground energetic material which has a more uniform particle size.

SUMMARY OF THE INVENTION

The invention is an improved method for reducing the particle size of particulate energetic materials including explosives such as RDX (cyclo-1, 3, 5-trimethylene-2, 4, 6-trinitramine), HMX (cyclotetramethylene tetranitramine) and the like.

A slurry of particulate energetic material having a solids content less than 40 percent and more typically between 5 and 30 percent is continuously introduced at a controlled rate into a high velocity stream of inert elastic fluid such as air or super-heated steam in a fluid energy mill. Interparticle collision reduces the mean particle size, and the smaller particles are separated by centrifugal force and discharged from the mill.

In one application of the invention, Class 1 RDX produced, shipped, and stored as a 25 percent solids slurry in water and alcohol is ground to the specifications of Class 5 RDX. The mean particle size is reduced by a factor of about 10–20.

The energetic particles are ground while in an aqueous slurry. The moisture on the particle surfaces absorbs thermal energy generated by the collisions preventing localized hot spots which may lead to detonation or burning. Thus, the process is inherently safer than the prior art dry grinding processes. Furthermore, the time and energy expended to dry the energetic materials is avoided.

The process of the invention is much simpler, less time consuming, and less expensive than the prior art recrystallization processes in current use. In addition, a narrower particle size spectrum is achieved.

DESCRIPTION OF THE ILLUSTRATED EMBODIMENTS

Figure 1:
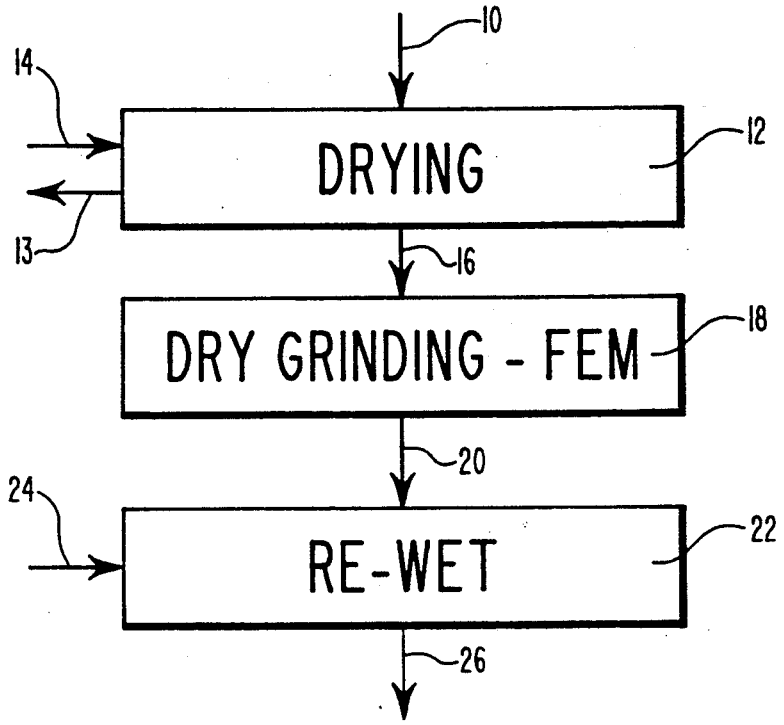
FIG. 1 (PRIOR ART)
FIG. 1 is a block diagram showing the steps of a prior art process for size reduction of energetic materials.
Figure 2:
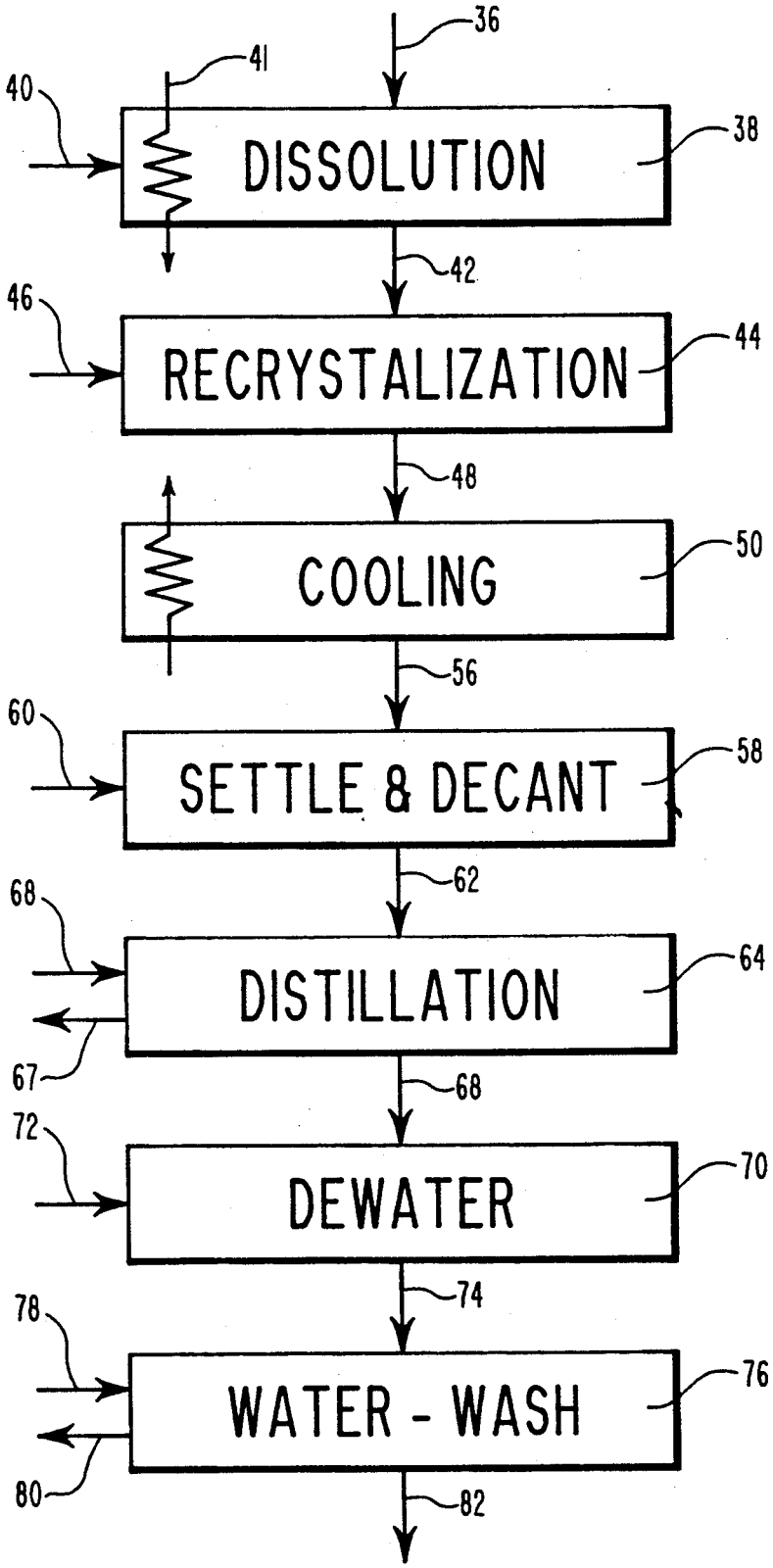
FIG. 2 (PRIOR ART)
FIG. 2 is a block diagram showing the steps of another prior art process for size reduction of energetic materials.

The two primary prior art methods of producing fine particle energetic material, e.g. Class 5 RDX, from production run material, e.g. Class 1 RDX, are illustrated in FIGS. 1 and 2.

FIG. 1 shows a prior art dry grinding method in current use for producing fine HMX, RDX and other energetic materials. The slurry 10 of energetic material typically contains 10–25 percent energetic solids mixed in an aqueous alcohol mixture. The slurry 10 is first dried in drying step 12 to drive off the water and alcohol mixture 13. Thermal energy 14 is provided for drying.

The dried energetic material 16 is then ground in a grinding mill such as a fluid energy mill in step 18.

The ground energetic material may then be re-wet in step 22 to form a slurry 26 of about 80-85 percent solids for storage or shipment. The wetting agent 24 is water, a mixture of water and alcohol, or other inert liquid or liquids.

This prior art process consumes very large quantities of energy 14 to dry the particulate energetic material 10. The required thermal energy required to dry material of 25 percent solids is over 1,400 kilogram calories per kg. material.

Another commonly used method of preparing finely divided RDX is by recrystallization, as illustrated in FIG. 2. The original manufacturing step in RDX manufacture results in a large particle size crude RDX. These particles of crude RDX are recrystallized under different conditions to produce finely divided material.

In the method of FIG. 2, wet crude RDX 36, or the like, is dissolved in step 38 in acetone 40 at about 135° F. (57° C.) heated by steam 41.

The hot solution 42 is recrystallized in step 44 by quenching with water 46.

The quenched material 48 is cooled in step 50.

The cooled material 56 is then settled and solvent 60 decanted in step 58.

To the settled material 62 is added water 66 in step 64, and acetone 67 is distilled off.

The solvent-free slurry 68 is then cooled to 122° and dewatered in step 70, discharging an aqueous stream 72 and a wet RDX stream 74 which is washed with water 78 in step 76 to remove traces of acetone 80. A water-wet slurry 82 of finely divided RDX is produced.

A somewhat similar recrystallization procedure is used for producing finely divided HMX.

The recrystallization procedure is cumbersome and time consuming. In addition, large quantities of toxic solvents must be handled, repurified, and disposed of.

Figure 3:
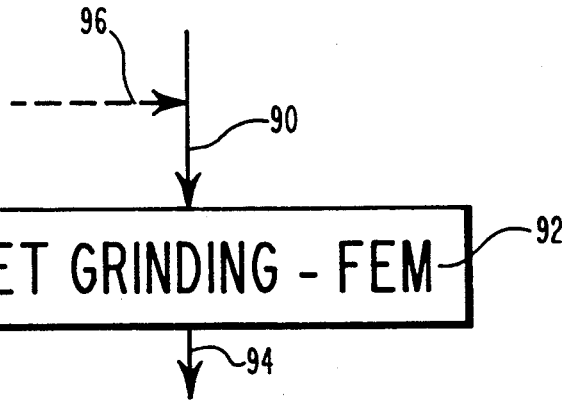
FIG. 3 is a block diagram of the invention.

The invention is schematically depicted in FIG. 3 and comprises the single step of introducing the as-produced slurry 90 of energetic material into a fluid energy mill (FEM) 92. The particles are ground in the wet state and discharged as stream 94 as a slurry of finely divided particles.

If the slurry 90 of coarse particles contains less than the desired moisture content, additional water 96 or other inert liquid carrier may be added to dilute the energetic stream 90 prior to grinding.

Figure 4:
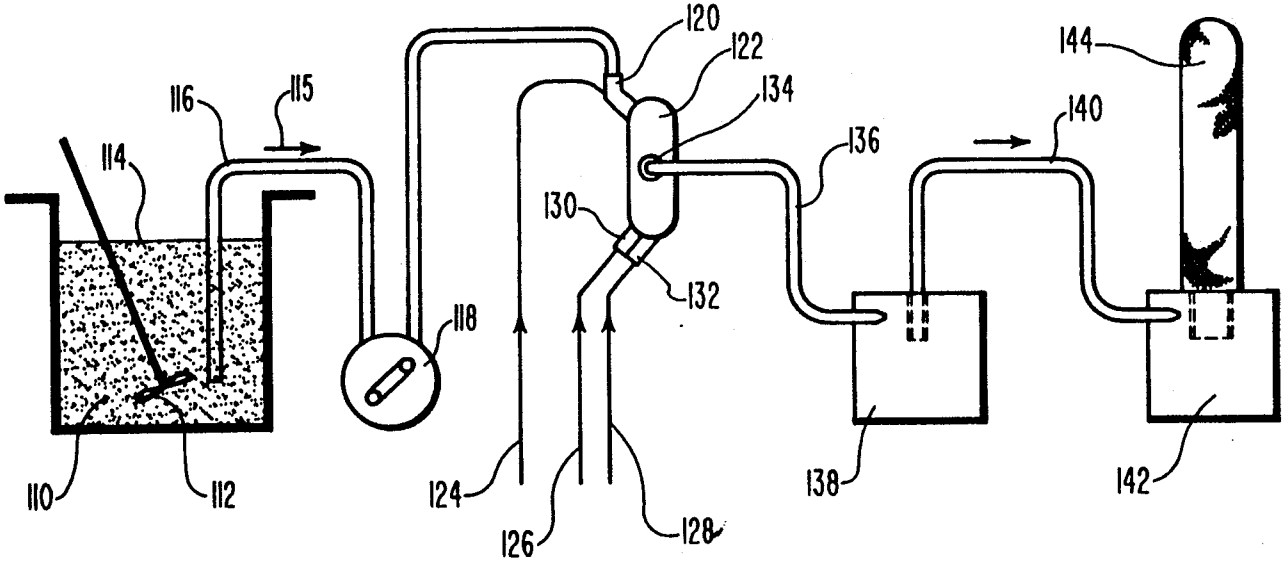
FIG. 4 is a schematic flow diagram showing the test equipment arrangement for evaluation of the invention.

FIG. 4 illustrates a laboratory arrangement for grinding energetic material slurries with a fluid energy mill.

The fluid energy mill is a grinding apparatus which relies on interparticle collision at high velocity for the breaking of the particles.

The Jet-O-Mizer ® mill, manufactured by Fluid Energy Process & Equipment Co., Hatfield, PA, is typical of fluid energy mills and has no moving parts. It has a hollow casing in the shape of an elongated torus generally situated in a vertical orientation. The mill has tangentially directed, small diameter jets or nozzles at the lower portion of the mill, i.e. the reduction chamber of the mill. An elastic fluid, i.e. a gas or vapor such as steam, air, nitrogen, or other gas, is introduced through the nozzles at pressures ranging from about 25 to 300 psig. The high pressure fluid produces a sonic or supersonic stream as it expands into the lower pressure of the mill. A high velocity flow of fluid is thus generated in the hollow, doughnut-shaped casing. The fluid velocity is typically in the range of 250–750 feet per second which produces intense interparticle collisions to grind the particulate material.

The centrifugal force of the circulating fluid causes the particles to become classified by size, and the small particles are continuously removed.

Other types of fluid energy mills may alternatively be used. In machines known as "pancake" mills, the fluid circulates in a horizontal plane. In other machines, multiple high velocity streams of particles are directed toward each other, head on or at oblique angles, to ensure high velocity interparticle collision.

As already described, fluid energy mills are grinding devices which use interparticle collision to break the particles into smaller fragments. Material to be pulverized is introduced into streams of elastic fluid traveling at sonic or supersonic velocity in a circuit. The fluid, usually air or steam, is discharged into the mill through specially designed nozzles.

The solid particles collide with each other and become pulverized as the velocity energy is converted to kinetic energy. The basis of the fluid energy mill is expressed in:

$$MV^2/2G$$

where

M = mass

V = relative fluid velocity, and

G = gravitational force constant.

The velocity of a fluid leaving a nozzle varies directly as the square root of the absolute temperature entering the nozzle. Thus, to obtain the maximum energy from the given mass of elastic fluid, it is desirable to preheat the fluid to a temperature as high as can be tolerated by the material being ground. The fluid energy mill is typically operated at velocities of 250–750 feet/second (75–225 m/sec).

Fluid energy mills have no moving parts. Grinding and dehydration are achieved by pressurized elastic fluids such as compressed air, compressed gases, or super-heated steam, for example.

Fluid energy mills useful for this invention have a hollow casing with a feed inlet, elastic fluid inlets, and a product outlet. The mills grind and classify the product simultaneously using centrifugal force to separate the particles according to particle size. The finely ground product material is continuously removed from the inside of a circulating stream and collected as a wet slurry. The wet slurry is then adjusted to the desired final solids content by the addition of water and/or other inert liquid.

The primary application of the invention is to the grinding of crystalline energetic materials, i.e. RDX, HMX, etc., for use in explosives. Such materials are available as relatively large particles in a water/alcohol solution at about 80–85 percent solids by weight. For example, Class 1 RDX with a mean particle size of about 100–200 microns is available as a slurry in a mixture of water and alcohol at about 80–85 percent solids.

In this invention, the particulate energetic material is continuously introduced into the fluid energy mill as a wet slurry without predrying. The final particle size is a function of the loading rate to the mill. An optimum loading exists for each type and size of particle to be ground. Loadings or feed rates higher than the optimum result in a high recirculating load in the mill, slowing the fluid rate and the available kinetic energy. Feed rates lower than optimum result in inefficient particle collision. In either case, the mean particle size will generally be larger than that achieved at the optimum loading.

EXAMPLE 1

Wet grinding of a HMX slurry was tested using a Jet-O-Mizer ® Model 020202 fluid energy mill, manufactured by Fluid Energy Process & Equipment Co. of Hatfield, PA.

The test equipment arrangement is depicted in FIG. 4 and is generally illustrative of a full-scale assemblage on a reduced scale. A five gallon feed tank 110 was stirred by air-driven agitator 112 to maintain the particulate feed material suspension 114 at a uniform concentration. A feed line 11 of Tygon ® tubing passed feed material 114 from feed tank 110 in direction 115 through air powered pump 118 to the inlet 120 of the Jet-0-Mizer ® fluid energy mill 122. A stream 124 of high velocity compressed air suspended the feed material at inlet 120 of the mill 122. In addition, further compressed air streams 126 and 128 were introduced into the mill 122 through first jet 130 and second jet 132, respectively.

In mill 122, the high velocity stream of air and particles flows in a circuit in which the larger particles stratify in the outside of the circuit while smaller, lighter particles move to the inside of the circuit. The small particles were continuously removed at exit 134 in a gas stream and directed through conduit 136 to the primary collector 138. The centrifugal gas flow in collector 138 resulted in separation and settling of the particulate solids therein while the gas then passed through conduit 140 to a secondary centrifugal collector 142 for removal of any residual particles in the gas. The clean gas was directed through a filter bag 144 and to the atmosphere.

In these tests, the first jet 130 was of 8/64 inch diameter and second jet 132 of 9/64 inch diameter.

A 25 percent slurry of HMX was prepared by mixing 450 g. HMX in 1,350 ml water and pouring into the feed tank 110. The agitator 112 was operated at 60 r.p.m. which maintained a uniform suspension in the feed tank. Air was turned on to the Jet-0-Mizer ® fluid energy mill 122. The air pressure to the feed inlet 120 was adjusted to 95 psig and to jets 130 and 132, 90 psig. The air was at ambient temperature.

The pump 118 was activated and run for five minutes to feed the HMX slurry 114 to the fluid energy mill 122 at a feed rate of 75 ml/min. After the pump was turned off, mill 122 was continued to run until empty and then turned off.

The conduits 136 and 140, i.e. hoses, the filter bag 144, and secondary collector 142 were washed into the primary collector 138. The slurry in the mill 122, conduit 116, and pump 118 was washed into the feed tank 110.

Samples of the original feed slurry, product slurry, and a small quantity of "dust" from filter bag 114 were each analyzed for particle size distribution. A Microtrac ® Series 9200 particle size analyzer, made by Leeds & Northrup, North Wales, PA, was used for the analyses.

Figure 5:
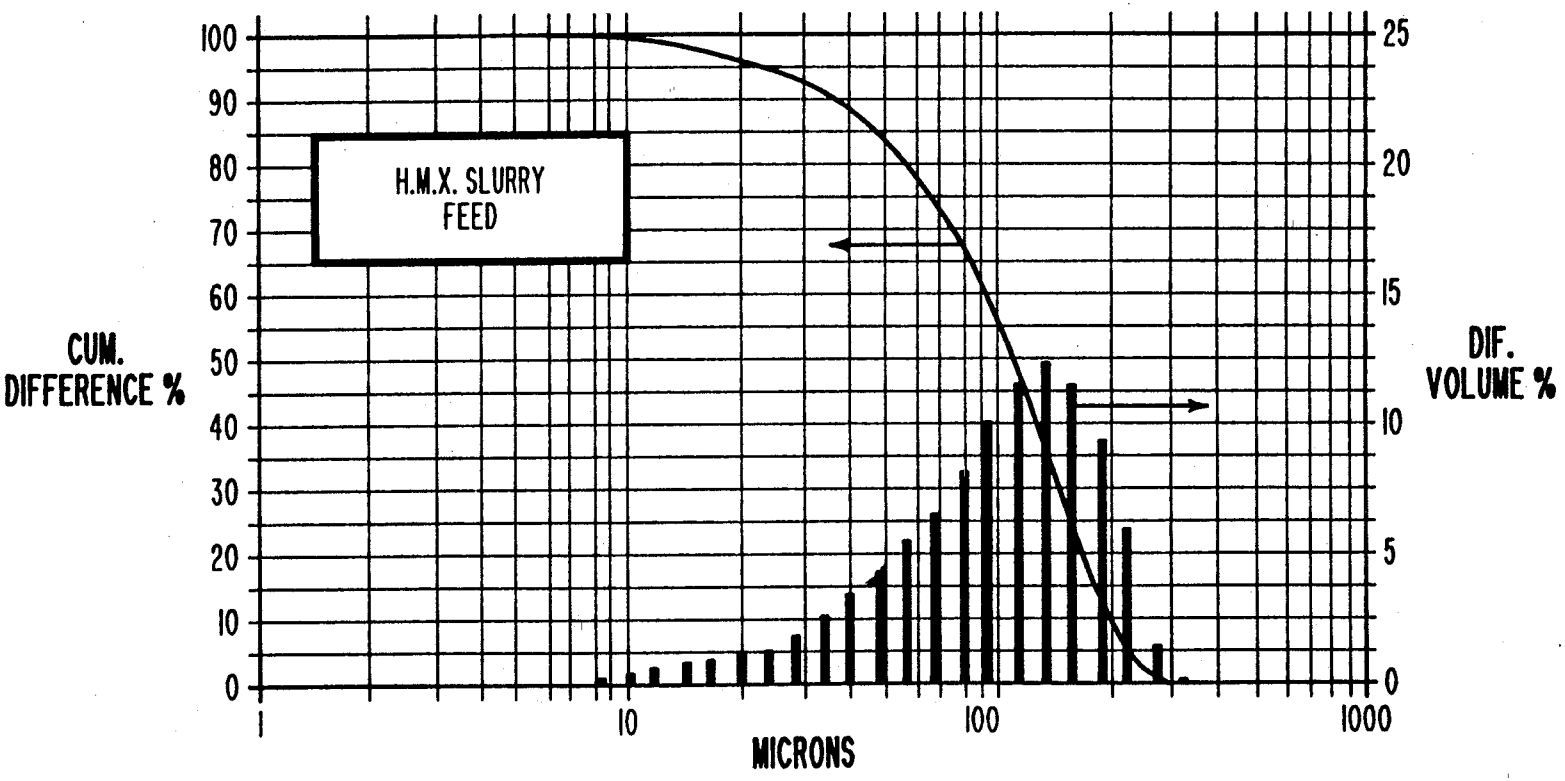
FIG. 5 is a graphical representation of the particle size distribution of an HMX feed slurry processed according to Example 1.

The feed slurry of HMX had the following particle size distribution which is plotted in FIG. 5, both as a histogram of differential volume percentage and as a cumulative curve versus particle size.

| Particle Size, Microns | Cumulative Percent of Feed Volume | Differential Percent in Size Cut |
|---|---|---|
| 296.00 | 0.2 | 0.2 |
| 248.90 | 1.6 | 1.4 |
| 209.30 | 7.6 | 6.0 |
| 176.00 | 16.9 | 9.3 |
| 148.00 | 28.3 | 11.4 |
| 124.45 | 40.5 | 12.2 |
| 104.65 | 51.9 | 11.4 |
| 88.00 | 62.0 | 10.1 |
| 74.00 | 70.0 | 8.0 |
| 62.23 | 76.5 | 6.5 |
| 52.33 | 81.9 | 5.4 |
| 44.00 | 86.3 | 4.4 |
| 37.00 | 89.7 | 3.4 |
| 31.11 | 92.3 | 2.6 |
| 26.16 | 94.2 | 1.9 |
| 22.00 | 95.6 | 1.4 |
| 18.50 | 96.7 | 1.1 |
| 15.56 | 97.6 | 0.9 |
| 13.08 | 98.4 | 0.8 |
| 11.00 | 99.0 | 0.6 |
| 9.25 | 99.5 | 0.5 |
| 7.78 | 99.8 | 0.3 |
| 6.54 | 100.0 | 0.2 |
| 5.50 | 100.0 | 0.0 |

These data are an average of nine particle size determinations using the Microtrac ® system. The mean particle size of the feed HMX, based on volume, was calculated to be 108 microns. This is the particle size at which 50 percent of the material volume has a larger size, and 50 percent is smaller.

Figure 6:
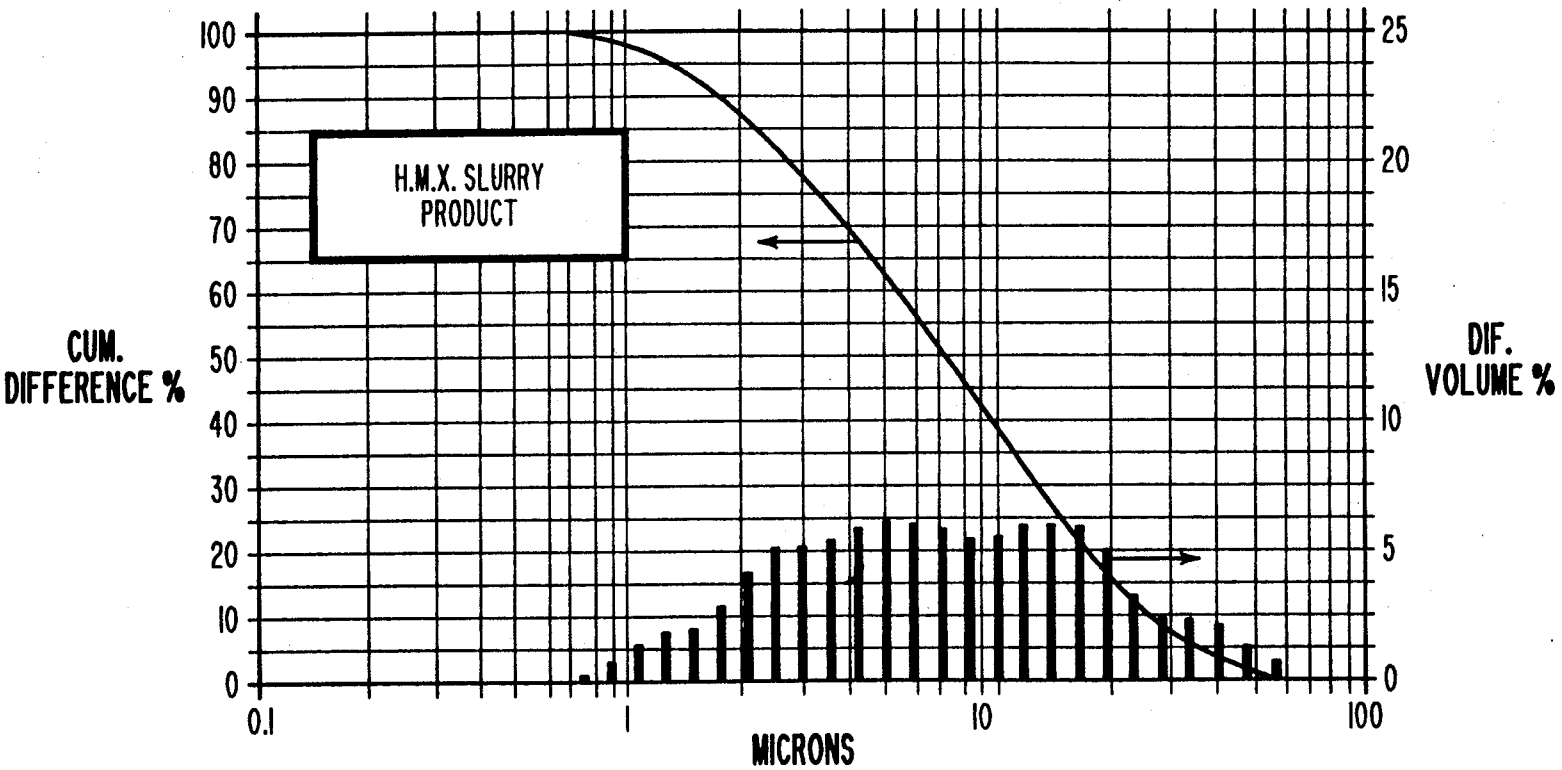
FIG. 6 is a graphical representation of the particle size distribution of an HMX ground according to the invention in Example 1.

The ground product HMX, averaged over nine tests, had the following particle size distribution which is also plotted in FIG. 6.

| Particle Size, Microns | Cumulative Percent of Product Volume | Differential Percent in Size Cut |
|---|---|---|
| 52.33 | 0.8 | 0.8 |
| 44.00 | 2.1 | 1.4 |
| 37.00 | 4.1 | 2.0 |
| 31.11 | 6.6 | 2.4 |
| 26.16 | 9.0 | 2.4 |
| 22.00 | 12.1 | 3.2 |
| 18.50 | 17.1 | 4.9 |
| 15.56 | 22.9 | 5.9 |
| 13.08 | 28.9 | 6.0 |

-continued

| Particle Size, Microns | Cumulative Percent of Product Volume | Differential Percent in Size Cut |
|---|---|---|
| 11.00 | 34.9 | 6.0 |
| 9.25 | 40.6 | 5.7 |
| 7.78 | 46.2 | 5.6 |
| 6.54 | 52.1 | 5.9 |
| 5.50 | 58.1 | 6.0 |
| 4.62 | 64.2 | 6.1 |
| 3.89 | 70.1 | 5.9 |
| 3.27 | 75.6 | 5.5 |
| 2.75 | 80.9 | 5.3 |
| 2.31 | 86.1 | 5.2 |
| 1.94 | 90.5 | 4.4 |
| 1.64 | 93.4 | 2.9 |
| 1.38 | 95.5 | 2.1 |
| 1.16 | 97.4 | 1.9 |
| 0.97 | 98.8 | 1.4 |

The mean particle size, as previously defined, was 7.02 microns.

Particle size analysis of the filter bag dust yielded the following average result (six tests):

| Particle Size, Microns | Cumulative Percent of Dust Volume | Differential Percent in Size Cut |
|---|---|---|
| 37.00 | 0.0 | 0.0 |
| 31.11 | 0.0 | 0.0 |
| 26.16 | 0.0 | 0.0 |
| 22.00 | 0.0 | 0.0 |
| 18.50 | 0.0 | 0.0 |
| 15.56 | 0.0 | 0.0 |
| 13.08 | 0.0 | 0.0 |
| 11.00 | 0.0 | 0.0 |
| 9.25 | 0.0 | 0.0 |
| 7.78 | 0.0 | 0.0 |
| 6.54 | 0.5 | 0.5 |
| 5.50 | 0.9 | 0.5 |
| 4.62 | 1.2 | 0.3 |
| 3.89 | 3.1 | 1.9 |
| 3.27 | 11.2 | 8.1 |
| 2.75 | 23.8 | 12.5 |
| 2.31 | 39.5 | 15.7 |
| 1.94 | 55.0 | 15.5 |
| 1.64 | 66.3 | 11.3 |
| 1.38 | 75.6 | 9.2 |
| 1.16 | 84.4 | 8.8 |
| 0.97 | 91.7 | 7.4 |
| 0.82 | 97.0 | 5.3 |
| 0.69 | 100.0 | 3.0 |

Figure 7:
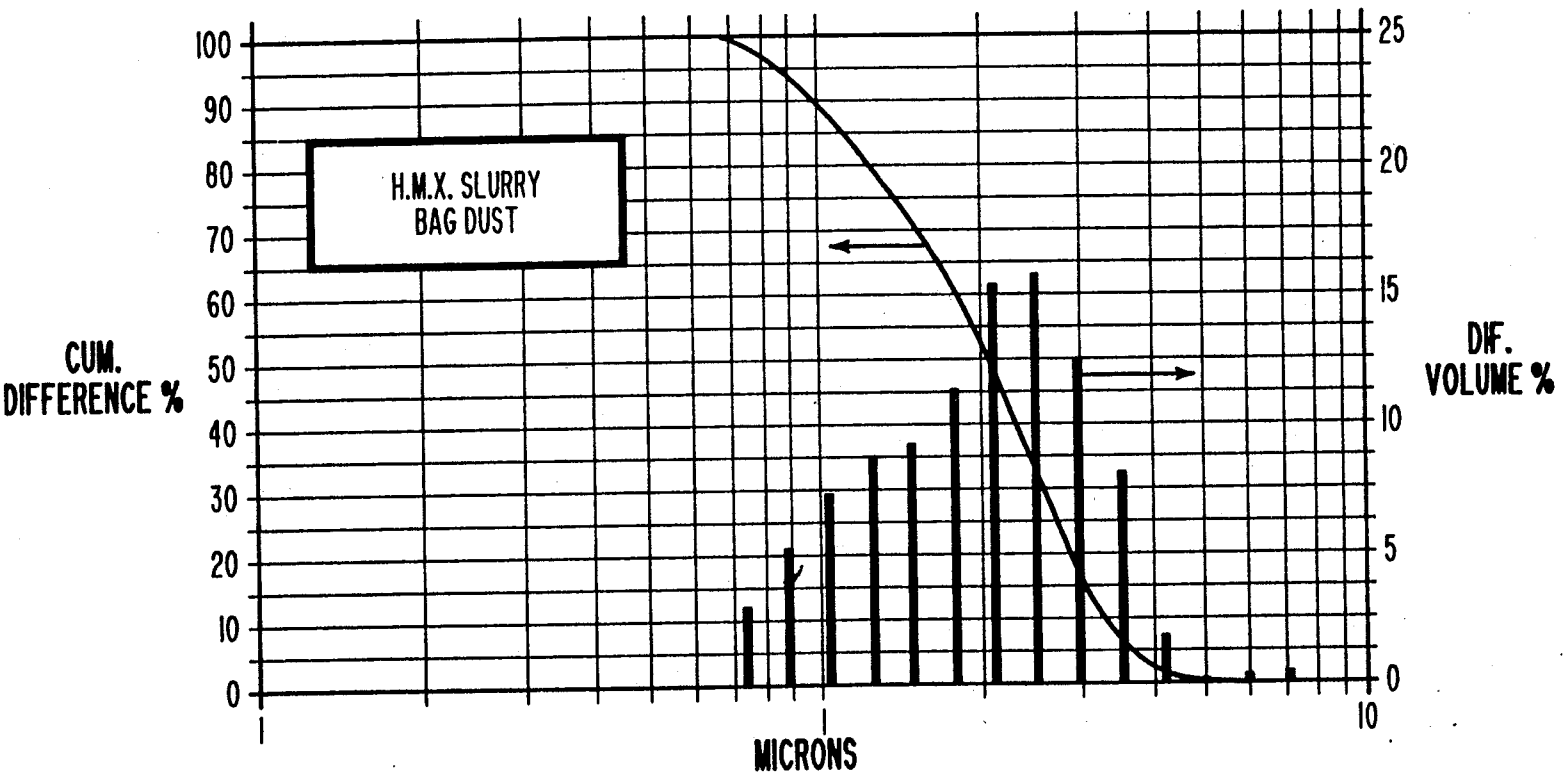
FIG. 7 is a graphical representation of the particle size distribution in ground HMX collected in the final filter bag of Example 1.

The data are plotted in FIG. 7. The mean particle size, as already defined, was 2.07 microns.

In summary, the grinding of a wet slurry of HMX under these conditions resulted in about a 15-fold decrease in mean particle size based on HMX volume. The particle size may be reduced further by grinding at a lower feed rate or higher fluid velocity or merely by subjecting the slurry to another grinding step in a fluid energy mill.

This process greatly enhances the safety, reduces the processing time, eliminates the environmental hazards associated with recrystallization solvents, and reduces the overall grinding costs.

Reference herein to details of the described and illustrated embodiments of the invention is not intended to restrict the scope of the appended claims which themselves recite the features regarded as important to the invention.

We claim:

1. A process for reducing the particle size of particulate crystalline energetic material comprising:

slurrying the particulate energetic particles in an inert liquid to a solids content less than about 40 percent, wherein said liquid coats the surfaces of said particles;

continuously introducing said slurried energetic particles at a controlled rate into a high velocity stream of inert elastic fluid in a fluid energy mill wherein interparticle collision reduces the mean particle size of said particulate energetic particles; and continuously separating and collecting wet energetic material of reduced particle size from said high velocity stream.

2. The process of claim 1 wherein said controlled rate is controlled whereby said interparticle collision reduces the mean particle size to less than 20 microns.

3. The process of claim 1 wherein said controlled rate and fluid velocities are controlled whereby said interparticle collision reduces the mean particle size to less than 10 microns.

4. The process of claim 1 wherein said liquid includes water.

5. The process of claim 1 wherein said liquid is a mixture of alcohol and water.

6. The process of claim 1 wherein said elastic fluid is at an elevated temperature.

7. The process of claim 6 wherein said elevated temperature is greater than about 80° C.

8. The process of claim 6 wherein said elevated temperature is about 80°–120° C.

9. The process of claim 1 wherein said particulate energetic particles are slurried in an inert liquid to a solids content less than about 30 percent.

10. The process of claim 1 wherein said velocity of said high velocity stream of elastic fluid is greater than about 75 m/sec.

11. The process of claim 1 wherein said elastic fluid comprises a gas.

12. The process of claim 1 wherein said inert elastic fluid includes super-heated steam.

13. The process of claim 1 wherein said inert elastic fluid includes gaseous nitrogen.

14. The process of claim 1 wherein said crystalline energetic particles comprise an explosive material.

15. The process of claim 1 wherein said crystalline energetic particles comprise crystalline nitramines.

16. The process of claim 1 wherein said stream of energetic particles and inert elastic fluid are directed in a circuit wherein said particles are classified by centrifugal force according to size.

17. The process of claim 1 wherein said slurry is introduced as a stream into high velocity streams of inert elastic fluid wherein said slurry containing fluid streams collide.

18. The process of claim 17 wherein said introduced slurry of particulate energetic material is a water wet slurry of Class 1 RDX.

19. The process of claim 18 wherein said separated and collected wet particulate energetic material meets the particle size specifications of Class 5 RDX.

20. A process for grinding a slurry of solid particulate energetic material, said slurry comprising less than 40 percent solids comprising:

continuously introducing a slurry of solid particulate energetic material into at least one high velocity stream of inert elastic fluid in a fluid energy mill wherein interparticle collision of wet particles reduces the mean particle size; and continuously separating and collecting wet particulate energetic material of a reduced particle size.

21. The process of claim 18 wherein at least 97 percent of said particulate energetic material is ground to a particle size less than 44 microns.

22. The process of claim 20 wherein said slurry of solid particulate energetic material contain 10–30 percent solids.

23. The process of claim 20 wherein said slurry includes water and an alcohol.

* * * * *